US011116279B2

(12) United States Patent
Chen et al.

(10) Patent No.: US 11,116,279 B2
(45) Date of Patent: Sep. 14, 2021

(54) SPORTS SHOE FOR CYCLING EXERCISE

(71) Applicant: GIANT MANUFACTURING CO., LTD., Taichung (TW)

(72) Inventors: Chun-Hung Chen, Taichung (TW); Stan Mavis, Seattle, WA (US)

(73) Assignee: Giant Manufacturing Co., Ltd., Taichung (TW)

( * ) Notice: Subject to any disclaimer, the term of this patent is extended or adjusted under 35 U.S.C. 154(b) by 0 days.

(21) Appl. No.: 14/669,717

(22) Filed: Mar. 26, 2015

(65) Prior Publication Data

US 2016/0213089 A1 Jul. 28, 2016

(30) Foreign Application Priority Data

Jan. 28, 2015 (TW) ..... 104102831

(51) Int. Cl.

| | |
|---|---|
| ***A43B 5/14*** | (2006.01) |
| ***A43B 23/02*** | (2006.01) |
| ***A43B 23/04*** | (2006.01) |
| ***A43C 11/16*** | (2006.01) |

(52) U.S. Cl.

CPC ..... *A43B 5/14* (2013.01); *A43B 23/025* (2013.01); *A43B 23/042* (2013.01); *A43C 11/165* (2013.01)

(58) Field of Classification Search

CPC ..... A43B 5/14; A43B 23/025; A43B 23/042; A43C 11/165; A41D 17/00

USPC ..... 36/131

See application file for complete search history.

(56) References Cited

U.S. PATENT DOCUMENTS

| | | | | | |
|---|---|---|---|---|---|
| 2,147,197 | A * | 2/1939 | Glidden | A43B 1/02 | 36/3 A |
| 3,128,567 | A * | 4/1964 | Huard | A43B 23/025 | 36/48 |
| 3,378,940 | A * | 4/1968 | Potvin, Jr. | A43B 3/14 | 36/11 |
| 4,298,210 | A * | 11/1981 | Lotteau | B62M 3/086 | 280/259 |
| 4,735,107 | A * | 4/1988 | Winkie | A43B 5/14 | 36/131 |
| 4,845,864 | A * | 7/1989 | Corliss | A43C 11/1493 | 36/131 |
| 5,345,638 | A * | 9/1994 | Nishida | A41H 3/08 | 12/146 C |
| 7,082,703 | B2 * | 8/2006 | Greene | A43B 3/0026 | 36/128 |
| 9,038,287 | B2 * | 5/2015 | Bell | A43B 1/0081 | 36/83 |
| 9,044,058 | B2 * | 6/2015 | Bell | A43B 1/0081 | |
| 2003/0029060 | A1 * | 2/2003 | Hockerson | A43B 5/02 | 36/67 R |

(Continued)

*Primary Examiner* — Jocelyn Bravo

(74) *Attorney, Agent, or Firm* — Finnegan, Henderson, Farabow, Garrett & Dunner, LLP

(57) ABSTRACT

A sports shoe for cycling exercise includes a shoe body a shoe body including an upper and a bottom for accommodating an exerciser's foot, the bottom defining a forefoot area, an arch area and a heel area, a reinforce element, and a fastening device, a reinforce element mounted at the forefoot area to make the structural strength of the shoe body around the forefoot area to be higher than the structural strength of the arch area and the heel area, and a fastening device connecting the arch area of the bottom and the upper for enabling the bottom to lift the foot.

20 Claims, 6 Drawing Sheets

(56) References Cited

U.S. PATENT DOCUMENTS

| | | | | |
|---|---|---|---|---|
| 2005/0166427 | A1* | 8/2005 | Greene | A43B 7/1495 36/128 |
| 2007/0240333 | A1* | 10/2007 | Le | A43B 17/10 36/30 R |
| 2008/0134545 | A1* | 6/2008 | Suzuki | A43B 5/007 36/131 |
| 2011/0107620 | A1* | 5/2011 | Bell | A43B 1/0081 36/83 |
| 2011/0113648 | A1* | 5/2011 | Leick | A43B 1/0081 36/50.1 |
| 2011/0113650 | A1* | 5/2011 | Hurd | A43B 7/20 36/107 |
| 2012/0000095 | A1* | 1/2012 | Torrance | A43B 13/188 36/132 |
| 2014/0007458 | A1* | 1/2014 | Berger | A43B 3/24 36/100 |
| 2014/0352173 | A1* | 12/2014 | Bell | D04B 21/207 36/50.1 |

* cited by examiner

SPORTS SHOE FOR CYCLING EXERCISE

BACKGROUND OF THE INVENTION

1. Field of the Invention

The present invention relates to sports shoe technology and more particularly, to a sports shoe for cycling exercise.

2. Description of the Related Art

When people wear shoes and are walking, the shoes can isolate the feet from the ground to provide protective and buffer effects, and the uppers and soles of the shoes must be able to fit the feet as close as possible so that the shoes can change their shape to match with different motion patterns of the feet. If you are going to wear sports shoes for exercises, you must select different sports shoes in accordance with different sport items.

For example, a sports shoe for bike riding is normally equipped with a sole that is made from a material having sufficient hardness and rigidity, and a fastening device 90 at the upper, as shown in FIG. 9. When wearing the sports shoe, the cyclist can operate the fastening device 90 to secure the shoe and the foot together, and then directly secure the rigid sole of the sports shoe to the clipless pedal of the bike, and thus, the sports shoe can directly drive the pedal and support the thigh of the cyclist for cycling the pedal strongly at a high speed to achieve the effects of enhancing transmission efficiency and pedaling the pedal with less effort.

Because the above-mentioned sports shoe for bike riding uses the fastening device 90 to downwardly hold down the upper on the cyclist's foot, the fastening device 90 and the upper directly force the cyclist's foot onto the sole of the sports shoe, producing a feeling of constriction in the contact area between the cyclist's foot and the upper of the shoe. Further, because the cyclist's foot is forced into contact with the sole of the sports shoe, the hardness of the sole can cause the cyclist's foot to be only locally supported on the sole of the sports shoe. When a cyclist wears this design of sports shoe for a long period of time, the cyclist's foot can feel uncomfortable soon because it is not fully supported.

SUMMARY OF THE INVENTION

The present invention has been accomplished under the circumstances in view. It is the main object of the present invention to provide a sports shoe for cycling exercise, which has better pedaling force transmission efficiency and can completely wrap around the foot to provide enhanced support and comfort, and is practical for cycling exercise that requires high flexibility and high degree of freedom.

To achieve this and other objects of the present invention, a sports shoe for cycling exercise is adapted for wearing on a human's foot. The sports shoe comprises a shoe body, a reinforce element, and a fastening device. The shoe body comprises an uppers and a bottom. The bottom defines a forefoot area, an arch area, and a heel area. The upper and the bottom accommodate the foot. The reinforce element is mounted at the forefoot area to make the structural strength of the shoe body around the forefoot area higher than the structural strength of the arch area and the heel area. The fastening device connects the arched area of the bottom and the upper, enabling the bottom to lift the foot. The upper, the arch area and the heel area wrap around and support the foot. Thus, the sports shoe enables the foot to be completely wrapped, providing better support and comfort. Further, the sports shoe is practical for cycling exercise.

Preferably, the arch area and the heel area can be made in one piece for wrapping around the foot. Alternatively, the arch area and the heel area can be formed of two connection segments that are joined together, enabling the uppers, the arch area and the heel area to support foot in well-fitting manner.

Preferably, the fastening device comprises a positioning member, a connecting member, and an adjustment member. The positioning member and the adjustment member are mounted at the shoe body. The connecting member is disposed between the positioning member and the adjustment member. The adjustment member can change the tightness of the connecting member, causing the fastening device to provide a force for tightening up the shoe body to the foot in conjunction with the effect of the bottom to lift foot, reducing concentration of local stress between the foot and the shoe body.

Preferably, the fastening device comprises a positioning member. The positioning member comprises a fixation portion located at the arch area. The positioning member extends along the surface of the arch area to the upper, enabling the fastening device to generate the technical effect of keeping the shoe body to completely wrap around the boot and to give better support to the foot.

Other advantages and features of the present invention will be fully understood by reference to the following specification in conjunction with the accompanying drawings, in which like reference signs denote like components of structure.

DETAILED DESCRIPTION OF THE INVENTION

Prior to reading the following specification in conjunction with the accompanying drawings, it is to be understood that a sports shoe for cycling exercise in accordance with the present invention is not limited to the specific structure, material, manufacturing technique, purpose and application purposes described in the following preferred embodiments. The terms used in the specification are exemplary description terms an ordinary person skilled in the art can understand, and all the terms are used for describing specific embodiments but not intended to limit the scope of the invention. Further, the singular forms "a", "an" and "the" contain a plural meaning, for example, one component or device can be formed of one single element or multiple elements, including its or their equivalents. All conjunctions used in a similar situation should also be understood to have the broadest sense. The specific shape, cross section and structural features or technical terms should be understood to include equivalent replacement structures or technical terms that can achieve the same functions.

Figure 1:
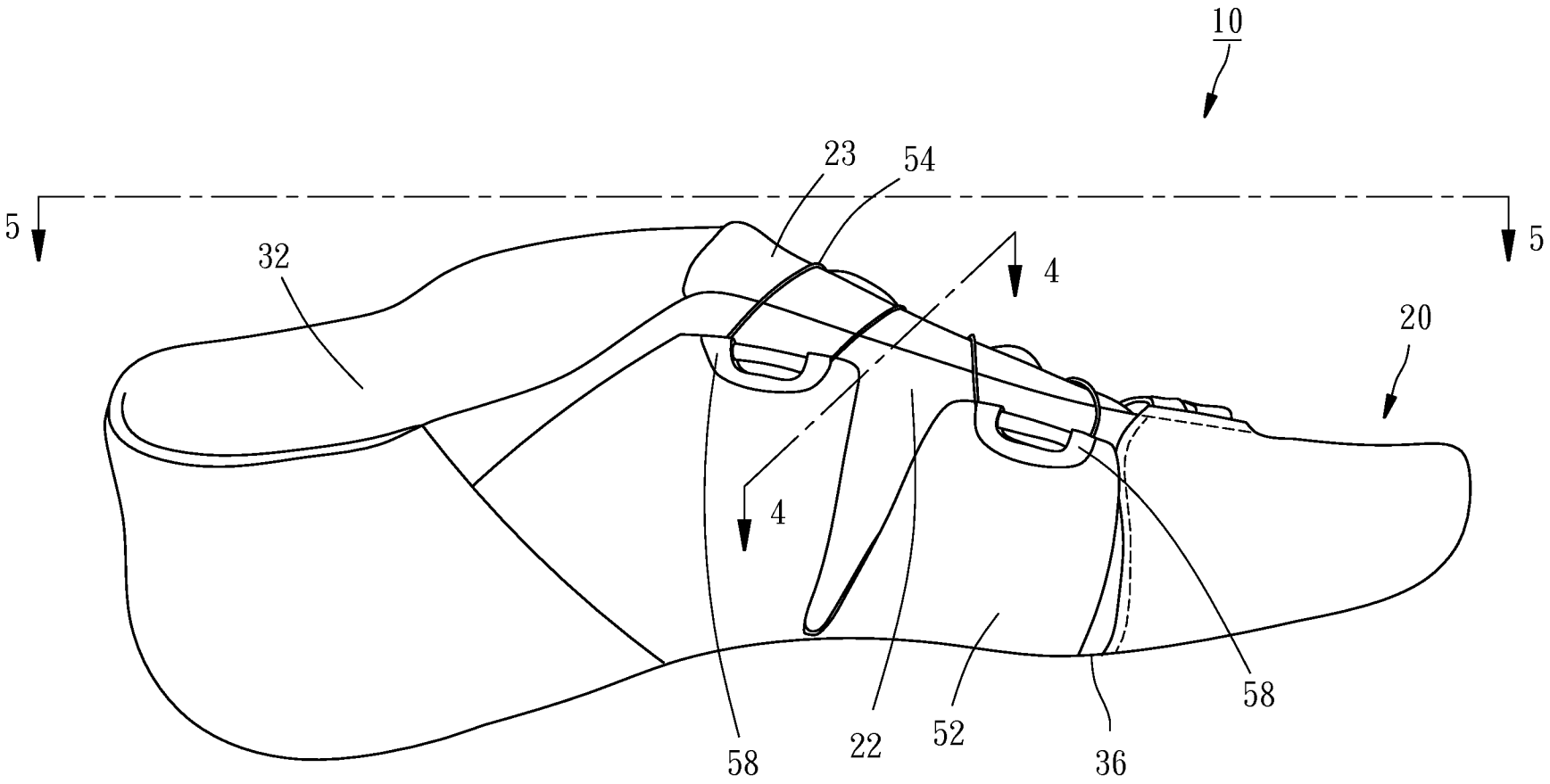
FIG. 1 is an oblique top elevational view of a sports shoe for cycling exercise in accordance with a first embodiment of the present invention.

Referring to FIG. 1, a sports shoe 10 in accordance with a first embodiment of the present invention is a cycling shoe. The sports shoe 10 is made from a material having sufficient hardness and rigidity, such as carbon fiber, glass fiber, or hard rubber. Alternatively, the sole can also be made from a composite material, or combined materials. The sports shoe 10 can be used with a clipless pedal system having self-locking pedals, such as SPD or ARC system. The sports shoe 10 of the invention is for wearing in an athlete's foot. The technical features of the invention described in this embodiment can be applied to a sports shoe for the left foot and a sports shoe for the right foot.

As shown in FIGS. 1-4, the sports shoe 10 comprises a shoe body 20, a reinforce element 40, and a fastening device 50. The shoe body 20 is made from a lightweight, bendable, elastic and tough material, such as natural fibers, synthetic fibers, leather, elastically deformable plastics and other materials with similar characteristics. The shoe body 20 comprises an upper 22 and a bottom 24. The shape of the bottom 24 corresponds to the shape of the foot, defining a forefoot area 26, an arch area 28, and a heel area 30.

Figure 2:
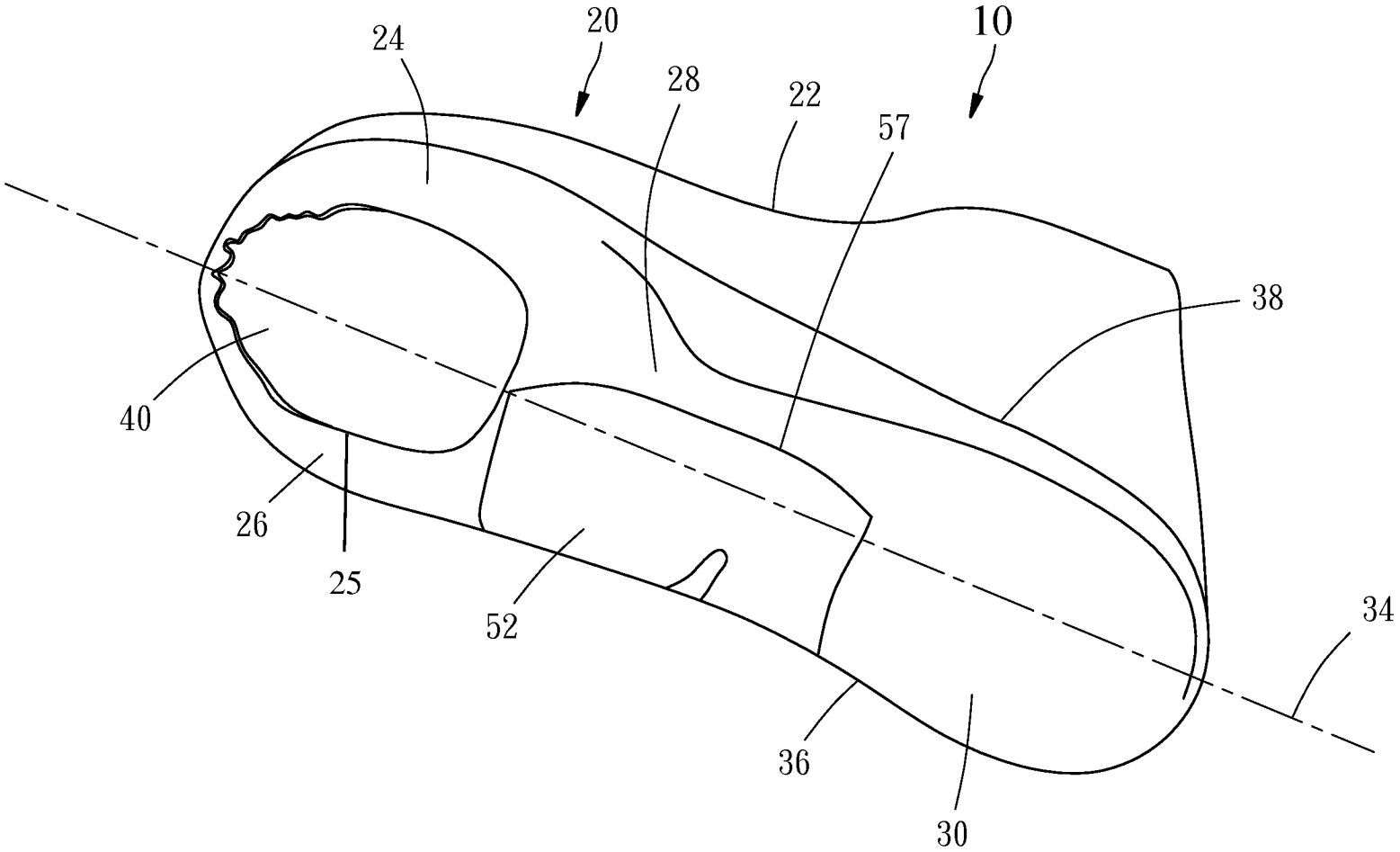
FIG. 2 is a schematic drawing of the first embodiment of the present invention, illustrating the configuration of the bottom.
Figure 4:
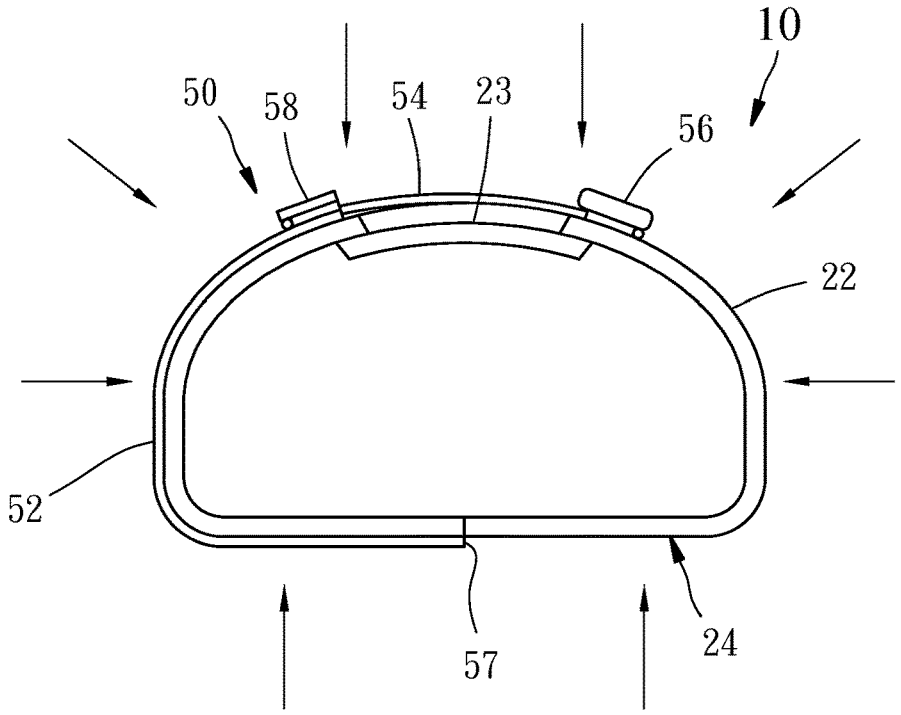
FIG. 4 is a sectional view taken along line 4-4 of FIG. 1.

As illustrated in FIG. 2, the upper 22 and the bottom 24 are preferably made in one piece. The upper 22 and the bottom 24 constitute an accommodation chamber 32 in the shoe body 20 for accommodating the foot. The bottom 24 defines a central axis 34 along the length thereof The shoe body 20 defines a first side edge 36 and a second side edge 38 in the junction between the uppers 22 and the bottom 24 and at two opposite lateral sides relative to the central axis 34. As shown in FIG. 1 and FIG. 4, the shoe body 20 further comprises a tongue 23 located at the upper 22. The tongue 23 can be formed of a part of the elastic material for shoe body or a separated piece member. The sectional length of the upper 22 between the first side edge 36 and the second side edge 38 can be adjusted through the tongue 23, thereby changing the dimension of the accommodation chamber 32 to fit different sizes of feet.

Figure 3:
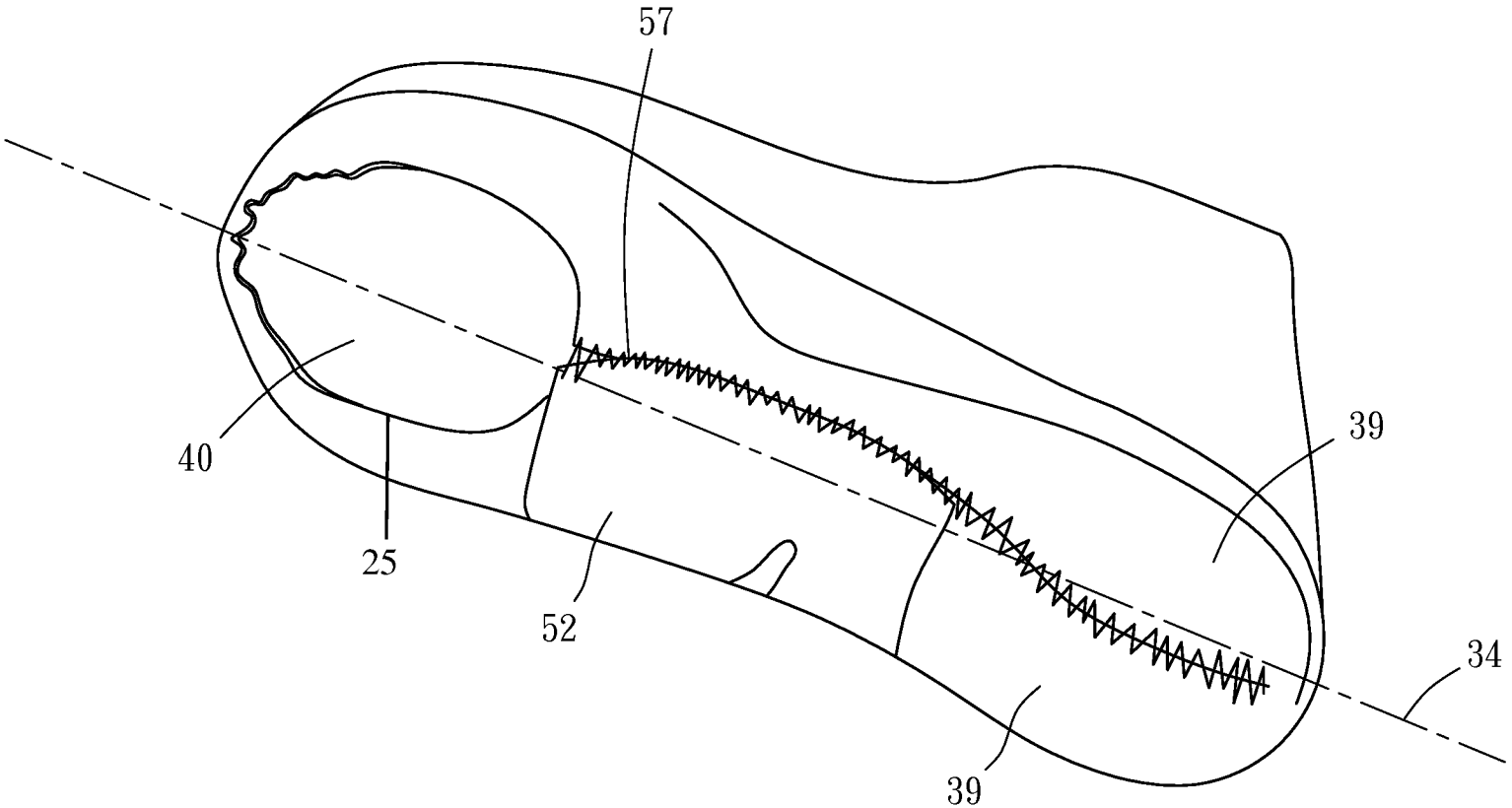
FIG. 3 is a schematic drawing of the first embodiment of the present invention, illustrating an alternate form of the bottom.

As illustrated in FIG. 2, the bottom 24 can be a one-piece member having the arch area 28 and the heel area 30 in integrity, and the structure of the forefoot area 26 can be variously embodied. Alternatively, as shown in FIG. 3, the arch area 28 and heel area 30 of the bottom 24 can be formed of two connection segments 39 respectively integrally extended from the first side edge 36 and the second side edge 38 and then stitched together, and the structure of the forefoot area 26 can also be variously embodied. The forefoot area 26 has a mounting hole 25 for mounting the sports shoe 10 with a pedal cleat.

Figure 5:
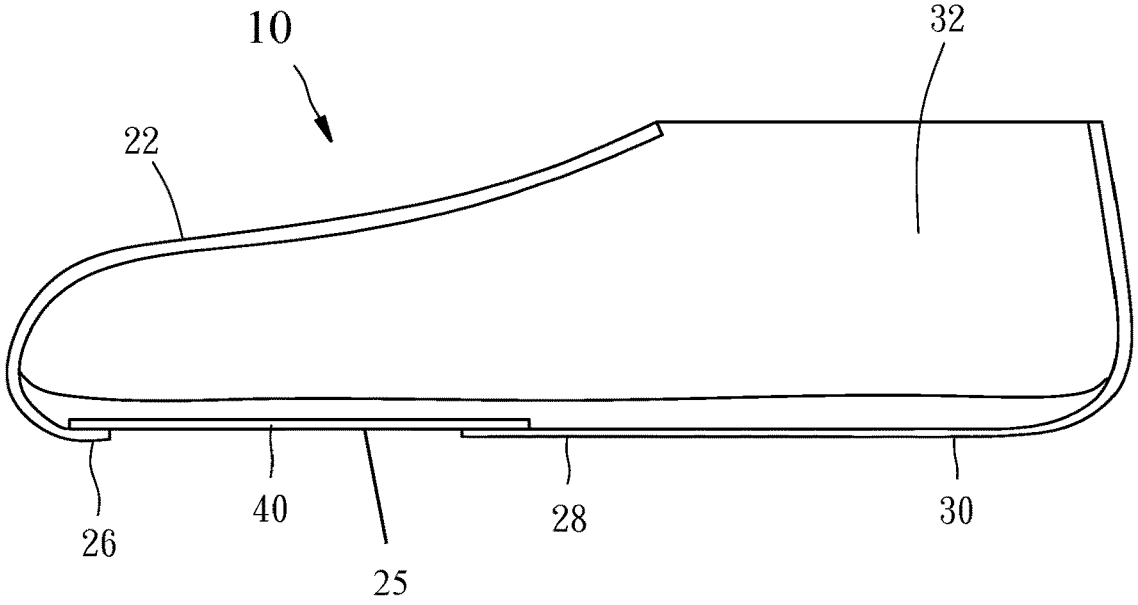
FIG. 5 is a sectional view taken along line 5-5 of FIG. 1.

The reinforce element 40 is made from a lightweight and high rigidity sheet material, such as carbon fiber composite material, high strength plastics, magnesium alloys, and other materials with similar characteristics. The reinforce element 40 is shaped like the forefoot area 26 of the bottom 24, and can be selectively affixed to the inner side or outer side of the forefoot area 26, as shown in FIG. 5. In this embodiment, the reinforce element 40 is affixed to the inner side of the bottom 24. The reinforce element 40 makes the structural strength of the bottom 24 of the shoe body 20 in the forefoot area 26 to be higher than that in the arch area 28 and the heel area 30. The bottom 24 can be added with an elastic outsole to cover the forefoot area 26, In addition to the function of protecting the reinforce element 40, the outsole can enhance the durability of the sports shoe 10 and can also be mounted with a pedal cleat.

As illustrated in FIG. 1, FIG. 2 and FIG. 4, the fastening device 50 in this first embodiment of the present invention is adapted for producing a force to tighten up the shoe body 20 to the foot. The fastening device 50 comprises a positioning member 52, a connecting member 54, and an adjustment member 56. The positioning member 52 and the adjustment member 56 are mounted at the shoe body 20, and respectively disposed at two opposite sides relative to the tongue 23. The connecting member 54 is disposed between the positioning member 52 and the adjustment member 56. Preferably, the positioning member 52 is made from a lightweight, bendable, elastic and tough sheet material, comprising a fixation portion 57 located at one side, and a plurality of supporting portions 58 located at an opposite side. The supporting portions 58 can be through holes cut through the positioning member 52, or guide grooves, barbs, or other similar structures capable of providing a positioning function and formed by curving and stitching the border edge of the positioning member 52 into shape. The positioning member 52 is mainly adapted for supporting the bottom 24 and upper 22 of the shoe body 20, more particularly for supporting the part of the shoe body 20 near the arch area 28.

In the configuration shown in FIG. 1, FIG. 2 and FIGS. 4-5, the fixation portion 57 of the positioning member 52 is directly bonded to the arch area 28 of the bottom 24 and kept in alignment with the centerline of the bottom 24, the part of the positioning member 52 corresponding to the junction between the first side edge 36 and the arch area 28 extends along the surface of the bottom 24 over the first side edge 36 to the upper 22, keeping the supporting portions 58 adjacent to one lateral side of the tongue 23, and thus, the positioning member 52 covers the area between one side of the upper 22 and the arch area 28. The contact area between the positioning member 52 and the shoe body 20 can be directly adhered or stitched together. The positioning member 52 and the upper can be detachably fastened together using hook and loop materials or like means, or alternatively, the connection between the positioning member 52 and the shoe body 20 can be done simply by affixing the fixation portion 57 to the bottom 24, leaving the other area of the positioning member 52 apart from the shoe body 20.

The connecting member 54 of the fastening device 50 can be selectively made from an elastic, tough strap or rope. The adjustment member 56 is joined with the connecting member 54 at the upper 22, and can control the tightness of the connecting member 54. The connecting member 54 and the adjustment member 56 can be a reel of the BOA Closure System. In this embodiment, the connecting member 54 is wound round between each supporting portion 58 of the positioning member 52 and the adjustment member 56, so that the connecting member 54 extends across of the tongue 23 of the upper 22 on both sides. When the connecting member 54 is pulled tight by the adjustment member 56, the pull force generated by the connecting member 54 can pull tight the two opposite lateral sides of the tongue 23 and the second side edge 38 and first side edge 36 of the bottom 24 via the positioning member 52 and the adjustment member 56. Further, using the positioning member 52 to connect the arch area 28 of the bottom 24 and the upper 22 not only can let the shoe body 20 shackle the foot but also enable the bottom 24 to lift the foot and the upper 22, the arch area 28 and the heel area 30 to cover and support the foot.

The sports shoe 10 can directly use the reinforce element 40 to enable the front side of the shoe body 20, more particularly the region around the forefoot area 26 have sufficient structural strength and rigidity so that the sports shoe 10 can be used with a clipless pedal system. After the ports shoe 10 and the clipless pedal are fastened together, the pedaling force can be efficiently transferred to the bike. After the sports shoe 10 is put on the foot, the rear half of the shoe body 20 covers the sole, ankle and instep of the foot. Because the reinforce element 40 makes the structural strength of the forefoot area 26 of the bottom 24 of the shoe body 20 become higher than the structural strength of the arch area 28 and the heel area 30, and because the upper 22, the arch area 28 and the heel area 30 are made from a material having lightweight, bendable, elastic and tough characteristics, when the foot changes the motion pattern during a cycling exercise, the whole shoe body 20 will be able to flexibly change its shape in fitting the configuration of the foot. Even if different exercisers have different foot sizes, the shoe body 20 can still provide enough flexibility to cover the foot in a well-fitting manner, and thus, the shoe body 20 will not affect pedaling efficiency, and can effectively support the foot.

Because the positioning member 52 of the fastening device 50 is mounted at the arch area 28 and extends along the bottom 24 to cover the surface of the upper 22, and the connecting member 54 is pulled tight by the adjustment member 56, the positioning member 52 can support the left half of the shoe body 20 (in the direction shown in FIG. 4) to lift the foot upwardly from the bottom 24. At the same time, the connecting member 54 works with the adjustment member 56 to support the right half of the shoe body 20 (in the direction shown in FIG. 4), enabling the upper 22 and bottom 24 of the shoe body 20 to completely wrap around the foot through 360 degrees. Thus, when compared to the functioning of the conventional cycling shoes to downwardly hold down the upper on the foot, the sports shoe 10 of the present invention does not give a pressure to a local area of the foot. When a user wears the sports shoe 10 for a long period of time, no friction will be produced between the shoe body 20 and the foot, avoiding friction injury and giving enhanced support and comfort.

Figure 6:
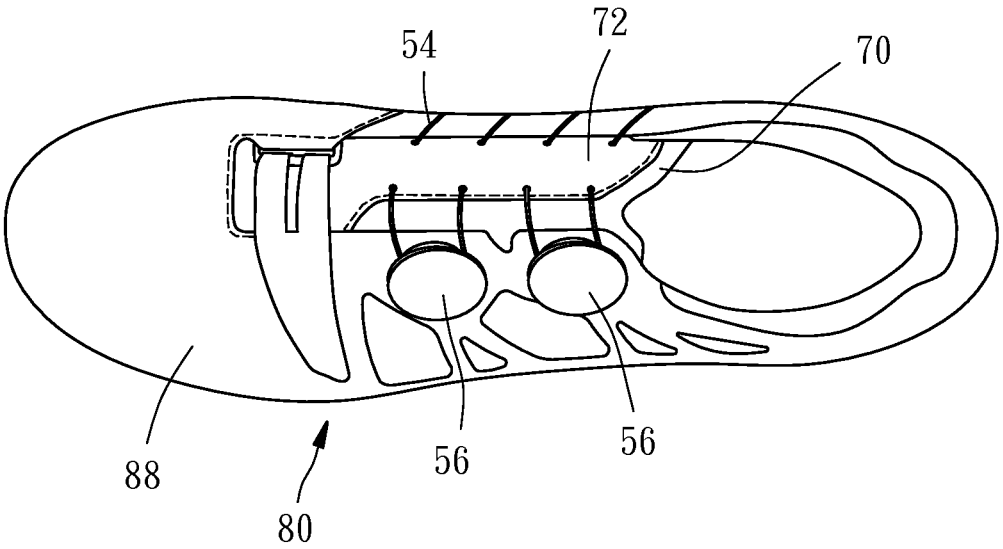
FIG. 6 is a top view of a sports shoe for cycling exercise in accordance with a second embodiment of the present invention.
Figure 7:
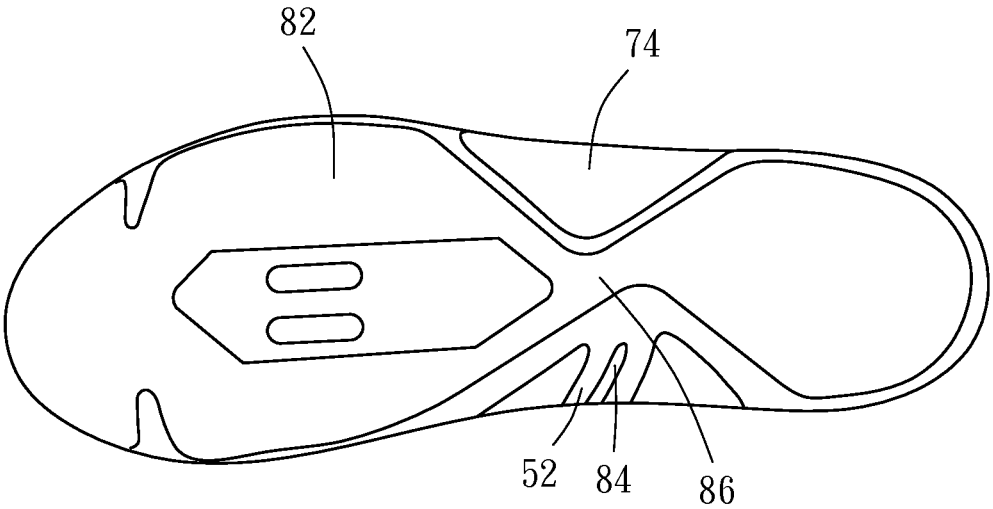
FIG. 7 is a bottom view of the sports shoe for cycling exercise in accordance with the second embodiment of the present invention.
Figure 8:
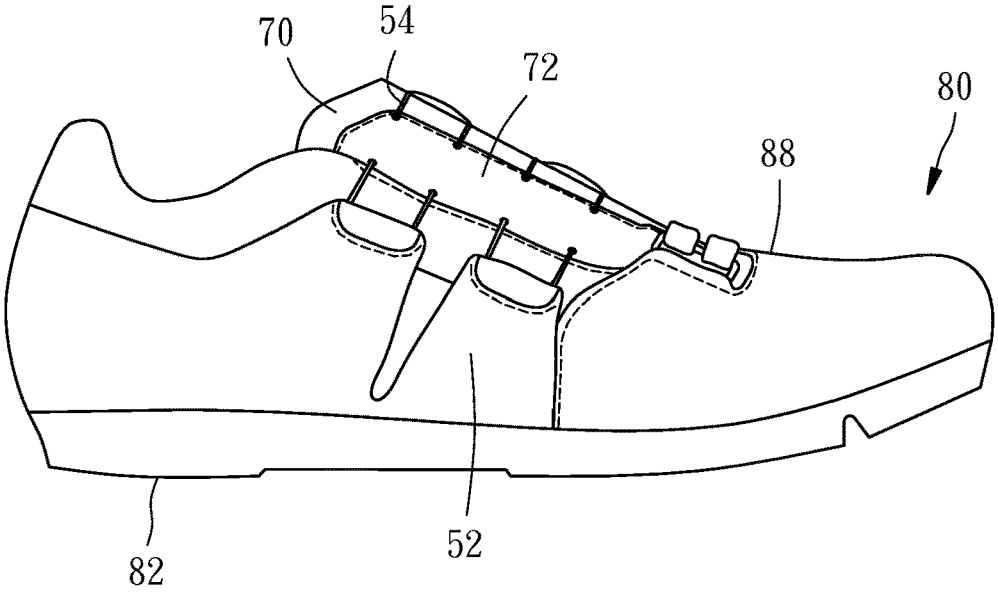
FIG. 8 is a side view of the sports shoe for cycling exercise in accordance with the second embodiment of the present invention.
Figure 9:
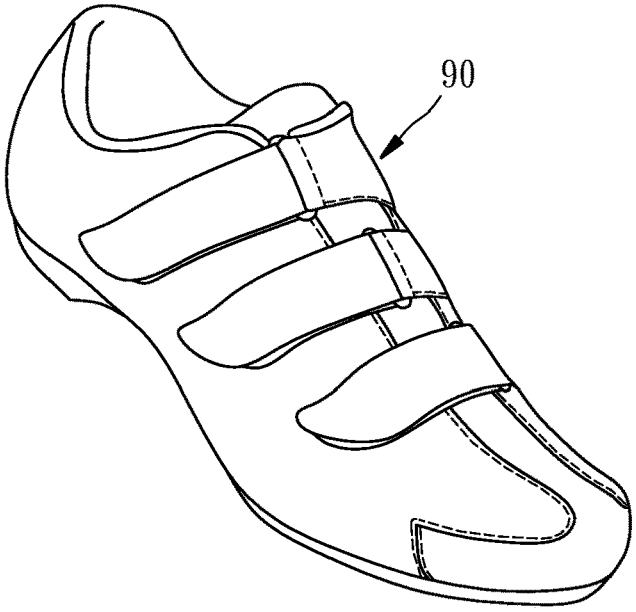
FIG. 9 is an oblique top elevational view of a cycling shoe according to the prior art.

Except the composition elements of the above-described first embodiment of the present invention, FIGS. 6-8 illustrate a sports shoe in accordance with a second embodiment of the present invention. This second embodiment further comprises a guide 72 located at the tongue 70 for the insertion of the connecting member 54, as shown in FIG. 7, and an outsole 82 located at the bottom 74 of the shoe body 80. The outsole 82 comprises a middle portion 86 corresponding to the arch area 84. The width of the middle portion 86 is smaller than the width of the arch area 84. Further, the positioning member 52 of the fastening device 50 is wrapped about the arch area 84 and one side of the upper 88; the connecting member 54 extends over the upper 88 between the positioning member 52 and the adjustment member 56, and is also inserted through the guide 72 of the tongue 70 so that when the connecting member 54 is pulled tight by the adjustment member 56, it can drive the positioning member 52 and also strengthen the upper 88, the tongue 70 and the foot, enhancing fitting and completely holding between the shoe body 80 and the foot. Further, the design of the middle portion 86 of the outsole 82 greatly enhances the lateral-torsional flexibility of the bottom 74 and the overall support.

Further, the fastening device can be made without the aforesaid adjustment member, for example, in the form of a hook and loop system, or other similar design in which the positioning member is disposed around the upper and the arch area, and the connecting member can pull the positioning member to tighten up the shoe body, achieving the same technical effects. Further, in the above-described embodiments of the present invention, the sports shoe is a cycling shoe, however, the technical features provided by the present invention can also be used for operating a pedal-driven or cycling mechanism-operated fitness equipment, achieving the same technical effects of the present invention.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A sports shoe, comprising:

a shoe body comprising an upper and a bottom, said bottom defining a forefoot area, an arch area, and a heel area, wherein said upper, said arch area and said heel area of said bottom are configured to cover and support a wearer's foot, the forefoot area having a mounting hole for mounting the sports shoe with a pedal cleat;

a reinforce element mounted at said forefoot area, wherein a structural strength of said shoe body is greater around said forefoot area than a structural strength of said arch area and said heel area; and a fastening device connecting said arch area of said bottom and said upper;

wherein the upper, the arch area, and the heel area comprise bendable and elastic material and the shoe body is configured to change to follow a configuration of the wearer's foot as a motion pattern of the wearer's foot changes during an exercise;

wherein said fastening device comprises a positioning member, said positioning member comprises a fixation portion mounted at said arch area of said bottom, the fixation portion being aligned with a centerline of the bottom;

wherein the fixation portion extends to the centerline of the bottom;

wherein the upper and the bottom are made in one piece.

2. The sports shoe of claim 1, wherein said arch area and said heel area are made in one piece.

3. The sports shoe of claim 1, wherein said bottom of said shoe body defines a central axis; said shoe body defines a first side edge and a second side edge in a junction between said upper, said bottom, and at two opposite lateral sides relative to said central axis; said arch area and said heel area are formed of two connection segments respectively integrally extended from said first side edge and said second side edge, the two connection segments being stitched together.

4. The sports shoe of claim 1, wherein said reinforce element is shaped like a shape of said forefoot area of said bottom, and selectively affixed to an inner side or outer side of said forefoot area.

5. The sports shoe of claim 1, wherein said fastening device comprises the positioning member, a connecting member, and an adjustment member, said positioning member and said adjustment member being mounted on said shoe body, said connecting member being disposed between said positioning member and said adjustment member, said adjustment member being configured to control the tightness of said connecting member.

6. The sports shoe of claim 5, wherein said positioning member covers a lateral side of said upper and said arch area; and said positioning member supports a part of said bottom around said arch area and said upper.

7. The sports shoe of claim 5, wherein a contact area between said positioning member and said shoe body is selectively adhered or stitched together, or detachably fastened together.

8. The sports shoe of claim 5, wherein said upper comprises a tongue; said positioning member and said adjustment member are mounted at said upper at two opposite sides relative to said tongue; said connecting member extends across the tongue on both sides between said positioning member and said adjustment member; and said positioning member connects said arch area of said bottom and said upper.

9. The sports shoe of claim 1, wherein said fastening device comprises the positioning member and a connecting member, said positioning member being directly bonded to said arch area, said connecting member being disposed between said positioning member and said upper, said connecting member being attached to said positioning member, wherein said arch area and said heel area are configured to cover and support said wearer's foot.

10. The sports shoe of claim 1, wherein the reinforce element is affixed on a foot-facing surface of said bottom.

11. A sports shoe, comprising:

a shoe body comprising an upper and a bottom, said bottom defining a forefoot area, an arch area, and a heel area, wherein said upper, said arch area and said heel area of said bottom are configured to cover and support a wearer's foot, the forefoot area having a mounting hole for mounting the sports shoe with a pedal cleat;

a reinforce element mounted at said forefoot area, wherein a structural strength of said shoe body is greater around said forefoot area than a structural strength of said arch area and said heel area; and a fastening device connecting said arch area of said bottom and said upper;

wherein the upper, the arch area, and the heel area comprise bendable and elastic material and the shoe body is configured to change to follow a configuration of the wearer's foot as a motion pattern of the wearer's foot changes during an exercise;

wherein said fastening device comprises a positioning member, said positioning member comprises a fixation portion mounted at said arch area of said bottom, the fixation portion being aligned with a centerline of the bottom;

wherein the fixation portion extends to the centerline of the bottom;

wherein the reinforce element is affixed on a foot-facing surface of said bottom.

12. The sports shoe of claim 11, wherein said arch area and said heel area are made in one piece.

13. The sports shoe of claim 11, wherein said bottom of said shoe body defines a central axis; said shoe body defines a first side edge and a second side edge in a junction between said upper, said bottom, and at two opposite lateral sides relative to said central axis; said arch area and said heel area are formed of two connection segments respectively integrally extended from said first side edge and said second side edge, the two connection segments being stitched together.

14. The sports shoe of claim 11, wherein said reinforce element is affixed to the foot-facing surface of said forefoot area.

15. The sports shoe of claim 14, wherein said reinforce element is shaped like a shape of said forefoot area of said bottom.

16. The sports shoe of claim 11, wherein said fastening device comprises the positioning member, a connecting member, and an adjustment member, said positioning member and said adjustment member being mounted on said shoe body, said connecting member being disposed between said positioning member and said adjustment member, said adjustment member being configured to control the tightness of said connecting member.

17. The sports shoe of claim 16, wherein said positioning member covers a lateral side of said upper and said arch area; and said positioning member supports a part of said bottom around said arch area and said upper.

18. The sports shoe of claim 16, wherein a contact area between said positioning member and said shoe body is selectively adhered or stitched together, or detachably fastened together.

19. The sports shoe of claim 16, wherein said upper comprises a tongue; said positioning member and said adjustment member are mounted at said upper at two opposite sides relative to said tongue; said connecting member extends across the tongue on both sides between said positioning member and said adjustment member; and said positioning member connects said arch area of said bottom and said upper.

20. The sports shoe of claim 11, wherein said fastening device comprises the positioning member and a connecting member, said positioning member being directly bonded to said arch area, said connecting member being disposed between said positioning member and said upper, said connecting member being attached to said positioning member, wherein said arch area and said heel area are configured to cover and support said wearer's foot.

* * * * *